United States Patent [19]

Becker

[11] Patent Number: 4,582,146

[45] Date of Patent: Apr. 15, 1986

[54] EARTH DRILLING APPARATUS

[76] Inventor: Floyd W. Becker, R.R. 9 Site 1, Box 15, Calgary, Alberta, Canada

[21] Appl. No.: 416,641

[22] Filed: Sep. 10, 1982

[30] Foreign Application Priority Data

Feb. 24, 1982 [CA] Canada ..... 396947

[51] Int. Cl.[4] ..... E21B 17/00

[52] U.S. Cl. ..... 173/149; 173/164; 175/220

[58] Field of Search ..... 173/149, 163–167, 173/1, 12, 140, 145, 146, 148, 152, DIG. 4, 141; 175/85, 220; 166/244 R; 73/862.21

[56] References Cited

U.S. PATENT DOCUMENTS

| | | | |
|---|---|---|---|
| 2,836,247 | 5/1958 | McCulloch . | |
| 3,052,301 | 9/1962 | Watts et al. | 285/142 X |
| 3,255,612 | 6/1966 | Mayer et al. . | |
| 3,280,920 | 10/1966 | Scott | 173/164 X |
| 3,471,177 | 10/1969 | Garrett et al. | 285/319 X |
| 3,741,589 | 6/1973 | Herd et al. | 285/141 X |
| 3,919,902 | 11/1975 | Johnson | 173/164 X |
| 4,037,672 | 7/1977 | Hodge | 173/164 X |
| 4,102,418 | 7/1978 | Kammerer | 175/324 |
| 4,190,119 | 2/1980 | Loftis | 173/163 X |
| 4,423,889 | 1/1984 | Weise | 285/302 X |
| 4,476,940 | 10/1984 | Reichert | 173/160 X |

FOREIGN PATENT DOCUMENTS

| | | |
|---|---|---|
| 253551 | 2/1927 | United Kingdom . |
| 1133744 | 11/1968 | United Kingdom . |

*Primary Examiner*—James M. Meister
*Assistant Examiner*—John L. Knoble
*Attorney, Agent, or Firm*—Hayes Davis & Soloway

[57] ABSTRACT

A drill pipe rotary drive mechanism for an earth drilling apparatus comprises a housing, a drive member mounted in the housing for rotation therein about a rotary axis and having an axial bore opening at each end to the exterior of the housing, and a drive mechanism in the housing for rotatably driving the drive member. A drive coupling tool is adapted to be readily removably mounted in the drive member so that the drive mechanism can be used for rotatably driving different types of earth drilling tools, the coupling tool having a tubular body portion telescopingly removably mounted in the axial bore of the drive member, the body portion having an axial opening extending therethrough for reception of a portion of the length of the drill pipe, a flange at one end of the body portion for abutting engagement with one end of the drive member for axially locating the coupling tool in the drive member, the coupling tool being adapted to be non-rotatably coupled to a drilling tool and to the drive member.

31 Claims, 27 Drawing Figures

EARTH DRILLING APPARATUS

This invention relates to an apparatus for drilling in earth formations and, more particularly, to a drill rig for use in mineral exploration and the like.

BACKGROUND OF THE INVENTION

As is well known, there are various types of earth drilling techniques, including those known as dual tube drilling, wire-line drilling, diamond drilling, conventional drilling, and drilling with augers. Heretofore, drill rigs or apparatus have been especially designed for each different type of drilling and substantial changes of the drill rig were necessary in order to change from one type of drilling to another type of drilling. Further, many conventional drill rigs were specifically adapted for driving one size of drill string. Again, substantial modifications of the apparatus are necessary to adapt the apparatus for a different size of drill string. A still further drawback of conventional drill rigs is that they are not adapted for carrying out all of the functions which are necessary to drive and extract a drill string.

With transportation costs rising at an ever increasing rate and mineral exploration being extended to more remote areas, including mountainous regions, it is becoming more difficult and costly to transport drilling equipment and personel to the drill site. For reasons which are apparent, the helicopter has received much favour as a mode of transportation. However, because of their limited carrying capacity, helicopters are unable to transport heavier conventional drilling rigs to remote locations, particularly those in elevated regions. Thus, there is a need for lighter drilling equipment which can more readily be transported by helicoper or trucks.

SUMMARY OF THE INVENTION

The present invention provides an arrangement which is easily and quickly modified for assembling drill string and drilling a bore hole, dismantling a drill string and use with different sizes of drill pipe.

The foregoing are achieved by the provision of a drill pipe drive mechanism adapted to rotatably drive any one of a plurality of removable generally tubular drill pipe coupling tools. The mechanism includes a housing and a coupling tool drive member or spindle rotatably and drivingly mounted in the housing. The spindle extends through the housing and is formed with an axial opening having means, such as splines or the like, for telescopingly receiving and non-rotatably coupling the drive spindles to any one of the coupling tools.

The invention provides generally two categories of drill pipe coupling tools. The first category is intended primarily for use in assembling and driving a drill string into an earth formation while the second category is intended primarily for use in dismantling and extracting a drill string from an earth formation. Each tool of both categories differ from one another in that it is specifically constructed for coupling to a drill pipe of a particularly outside diameter. However, all of the tools have substantially the same exterior configuration so that all can be mounted in and driven by the drive spindle without any modification of the drive mechanism.

Each coupling tool also includes an axial opening through which a portion of a drill pipe extends. One end, the upper end, of the tools is formed with an outwardly extending flange which is abuttingly engageable with the upper end of the drive spindle. The other end, the lower end, is formed to receive means for removably retaining the tool operatively disposed in the drive spindle. In addition, the flange and retaining means cooperate to define predetermined limits of axial travel of the coupling tools with respect to the drive spindle during assembly and disassembly of drill pipe sections as will be described in greater detail later.

When it is desired to assemble and drive a drill string, a coupling tool of the appropriate size of the first category is selected and simply telescopingly inserted with the upper end of the drive spindle opening until the flange seats onto the upper end of the spindle and then the retaining means is attached to the lower end of the tool. When it is desired to drive pipe of a different size or dismantle the drill string, the retaining means is simply removed from the tool mounted in the drive spindle, the tool telescopingly removed and the replacement or substitute tool inserted in the manner described above. Thus, it will be seen that the modification of the drive mechanism for different functions or sizes of pipe is extremely simple and therefore the arrangement considerably reduces labour cost associated with such modification.

In order to render the drilling rig capable of transportation by helicopter, the drilling rig is constructed in at least two modules so that each module can be independently transported to the drilling site. One module consists of an air compressor, including a compressed air reservoir and prime mover, for supplying air down the drill string as is well known. Another module consists of a mast assembly including a drill pipe drive mechanism and a hydraulic system, including prime mover, a hydraulic pump and controls, and fluid reservoir. The mast assembly is also constructed as an integral unit which is removably mounted on the module. Thus, if a particular vehicle or helicopter does not have the capacity to carry the entire module, the mast assembly can readily be removed and transported independently. Further, the drive mechanism actuating means is arranged in such a manner as to reduce the strength requirements of the mast and thereby reduce the overall weight of the module.

BRIEF DESCRIPTION OF THE DRAWINGS

These and other features of the invention will become more apparent from the following description in which reference is made to the appended drawings wherein.

DETAILED DESCRIPTION OF A PREFERRED EMBODIMENT

The primary function of the drill rig of the present invention is to assemble and rotatably drive a drill string into an earth formation at a desired drilling site and extract and dismantle the drill string. A drill string is comprised of serially connected lengths of drill pipe. Each length of pipe is threaded at each end for threaded engagement with one end of an adjacent pipe.

Figure 1:
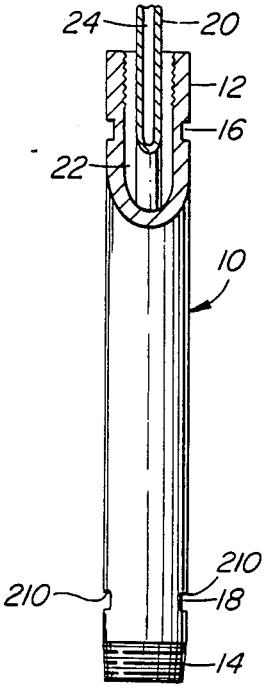
FIG. 1 is a view illustrating a form of drill pipe with which the present drill rig is adapted to be used.

As shown in FIG. 1, one end of the pipe 10 is formed with an internal thread and is referred to as a "box" 12. The other end of the pipe is formed with an external thread, referred to as a "pin" 14 A cutting bit (now shown) is connected to the lowermost pipe section.

Adjacent the box and pin of each pipe section are a pair of flattened diametrically opposed recesses or slots. The slots are provided for threadedly engaging and disengaging ("breaking") a pair of pipe sections. The slots adjacent the box are engageable with a hydraulic break-out wrench and called "box end break-out slots" 16, while the slots adjacent the pin, called "pin end break-out slots" 18, are engageable with pivoted dogs of a break-out tool removably mounted in the pipe drive mechanism.

While not limited thereto, the present invention is particularly intended for use with double or dual-wall pipe sections wherein an inner pipe 20 is concentrically mounted within the above described pipe in a well known manner. The inner and outer pipe members together define an annular passageway 22 for communicating a fluid, such as air, from the surface to the cutting bit and the inner pipe defines a bore 24 for communicating the fluid and cuttings to the surface.

Figure 2:
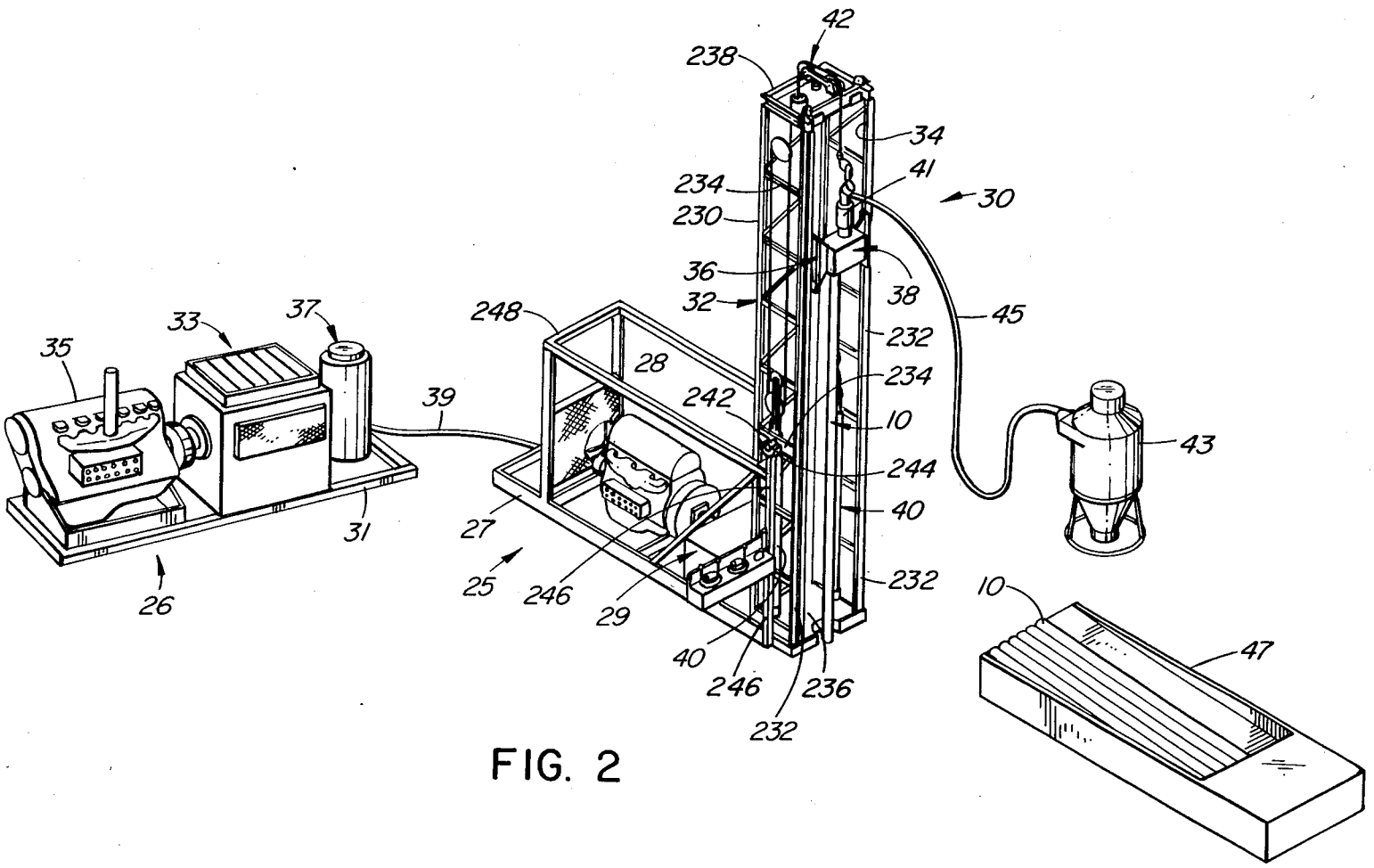
FIG. 2 is a diagrammatical, perspective view illustrating the various components of the drill rig of the present invention.

The major components of the drill rig are provided by two separate modules 25 and 26, each having a weight which is readily transportable by helicopter. Module 25 includes a sled or base 27 on which are mounted a mast assembly 30, a prime mover 28, such as a diesel engine, a hydraulic system 29 including a hydraulic pump and reservoir for suppling pressured fluid to various hydraulic cylinders and motors of a mast assembly 30. Module 26 includes a sled 31 carrying a compressed air system 33, including an engine 35, a compressor and reservoir 37, for supplying pressurized air via conduit 39 to an air swivel discharge device 41 mounted on a drill pipe drive mechanism of assembly 30. The discharge device, in turn, supplies air to passageway 22 as explained earlier. The air swivel discharge device also connects the outlet of bore 24 of inner pipe 20 to a cyclone 43 via conduit 45 in a manner well known to those skilled in this art. Lengths of pipe sections 10 are stored in a pipe rack 47 as shown in FIG. 2.

The mast assembly 30 (FIG. 2) includes a mast 32 having a track 34, a carriage 36 movable along the track, a drill pipe rotary drive mechanism 38 mounted on the carriage, a carriage actuating mechanism 40 mounted on the mast, a hoist mechanism 42 for hoisting the drill string or the drive mechanism mounted on the mast and a "break-out wrench" mechanism 44 (FIG. 25) mounted on the base of the mast. Each of these components are described in greater detail hereinafter. The following description outlines the general features and purpose of these components.

The mast 32 operatively supports the other above mentioned components of the assembly 30. It is operatively supported in a vertical position. The track 34 extends longitudinally of the mast and is comprised of a pair of facing channels disposed at two adjacent corners at the front side of the mast. The mast is illustrated in detail in FIGS. 2 and 18–23 (in phantom lines).

The carriage 36 is connected to actuating mechanism 40 for vertical movement along track 34. Its primary function is to support the pipe drive mechanism 38. Carriage 36 is best illustrated in FIGS. 3, 4, 16 and 17.

The rotary pipe drive mechanism 38, hereinafter called "top drive", defines a rotary axis and is mounted on the carriage for movement therewith longitudinally of the mast and pivotal movement about a horizontal axis between a first position and a second position. The first position is the normal operating position of the top drive wherein the rotary axis is substantially vertical and the top drive rotatably drives a pipe coupling tool for driving a drill string, threadedly engages or disengages a pair of pipe sections or hoists the drill string as will be explained in greater detail later. The second position is the position in which the top drive is disposed when pipe is added and removed. In this position, the top drive is disposed about 90° from the first position with the underside of the top drive facing outwardly away from the mast and the rotary axis is substantially horizontal. A detent mechanism is provided for resiliently retaining the top drive in either position. The top drive is illustrated in FIGS. 3–6.

The carriage actuating mechanism 40 is generally comprised of a pair of hydraulic cylinders disposed on opposite sides of the mast, adjacent the side on which the carriage is moveable, and mounted on the base of the mast. The hydraulic cylinders are operatively connected to the carriage by cables arranged for selectively, reversibly actuating the carriage. The actuating mechanism is best illustrated in FIGS. 18–21.

Figure 22:
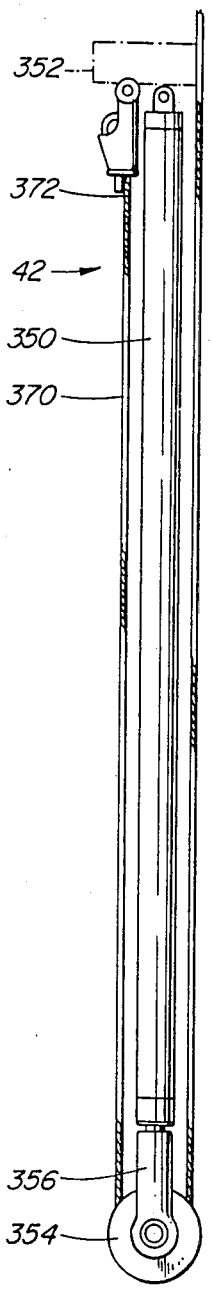
FIGS. 22 and 23 are views similar to FIGS. 18 and 19, respectively, but illustrating the hoist mechanism.
Figure 23:
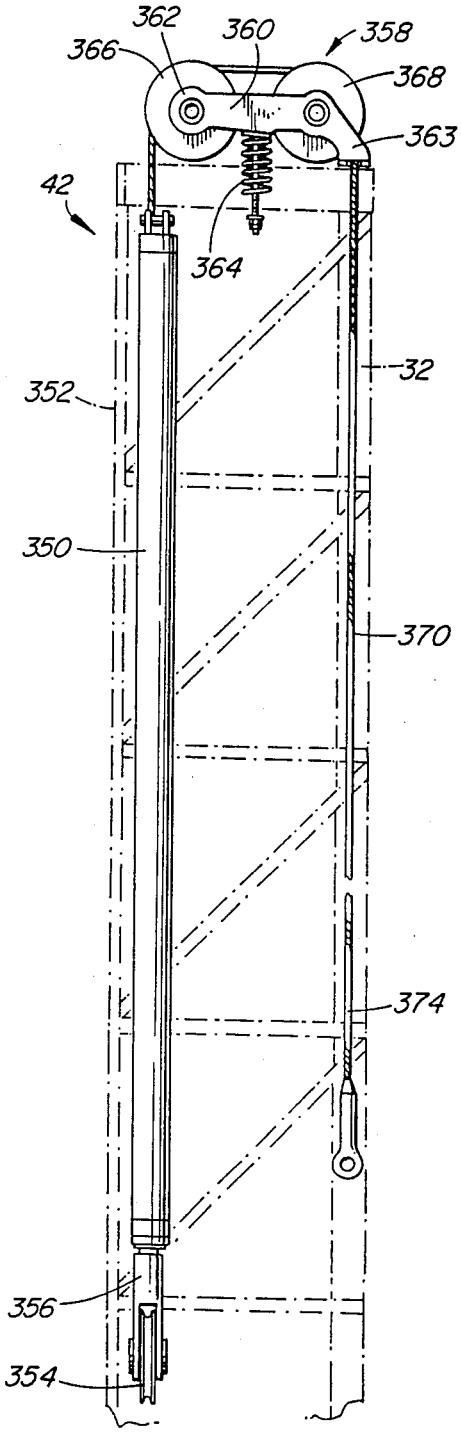

The hoist mechanism 42 is generally comprised of a single hydraulic cylinder disposed adjacent the side of the mast opposite the side on which the carriage is mounted and is mounted on the crown of the mast. The hoist mechanism is selectively connectable to either the upper length of pipe of drill string or the top drive for raising the drill string, as will be explained in greater detail hereinafter. The hoist mechanism is best illustrated in FIGS. 22 and 23.

Figure 25:
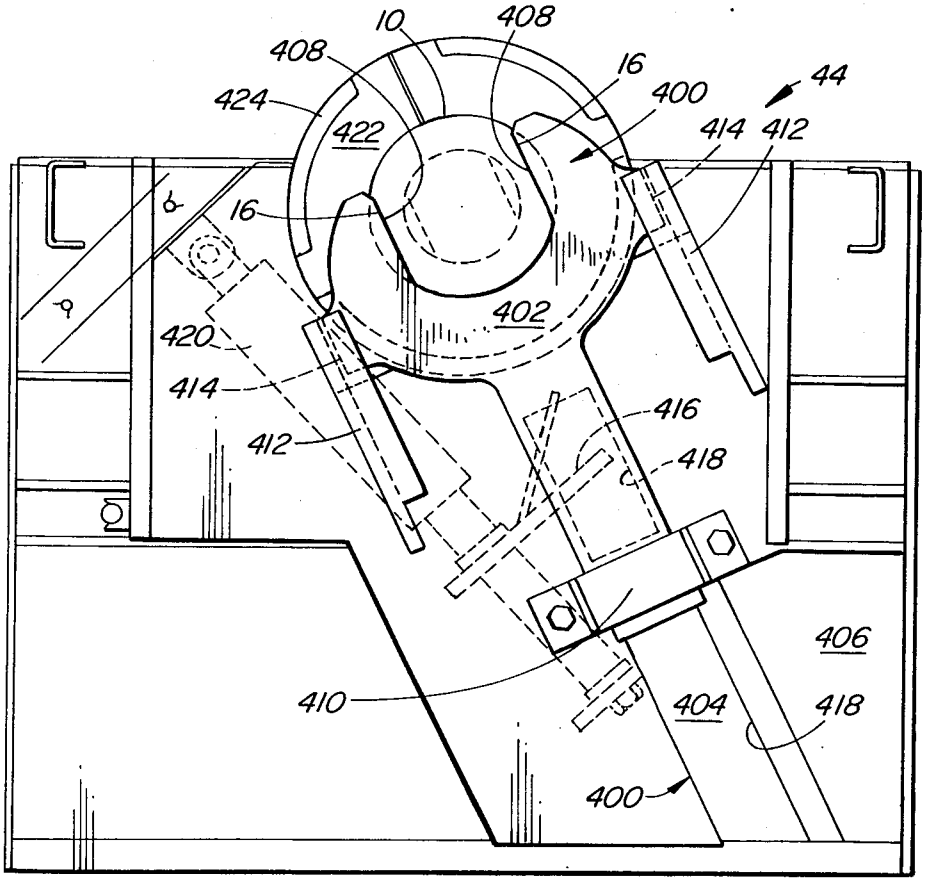
FIG. 25 is a top view of the break-out wrench mechanism illustrating the wrench operatively engaged with a section of pipe.

The break-out wrench mechanism 44 is a hydraulically actuated, extendable and retractable wrench for selectively engaging a pipe section and preventing rotation thereof during assembly and disassembly of a drill string. The break-out mechanism is best illustrated in FIG. 25.

ROTARY PIPE DRIVE MECHANISM—TOP DRIVE

Figure 3:
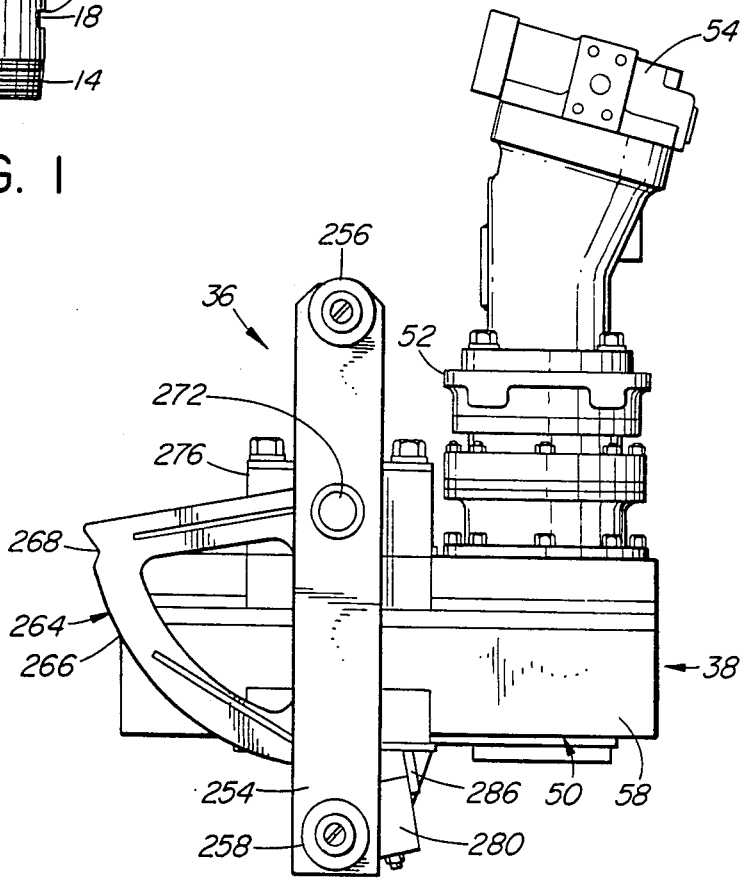
FIG. 3 is a side elevational view of the carriage and pipe drive mechanism.
Figure 4:
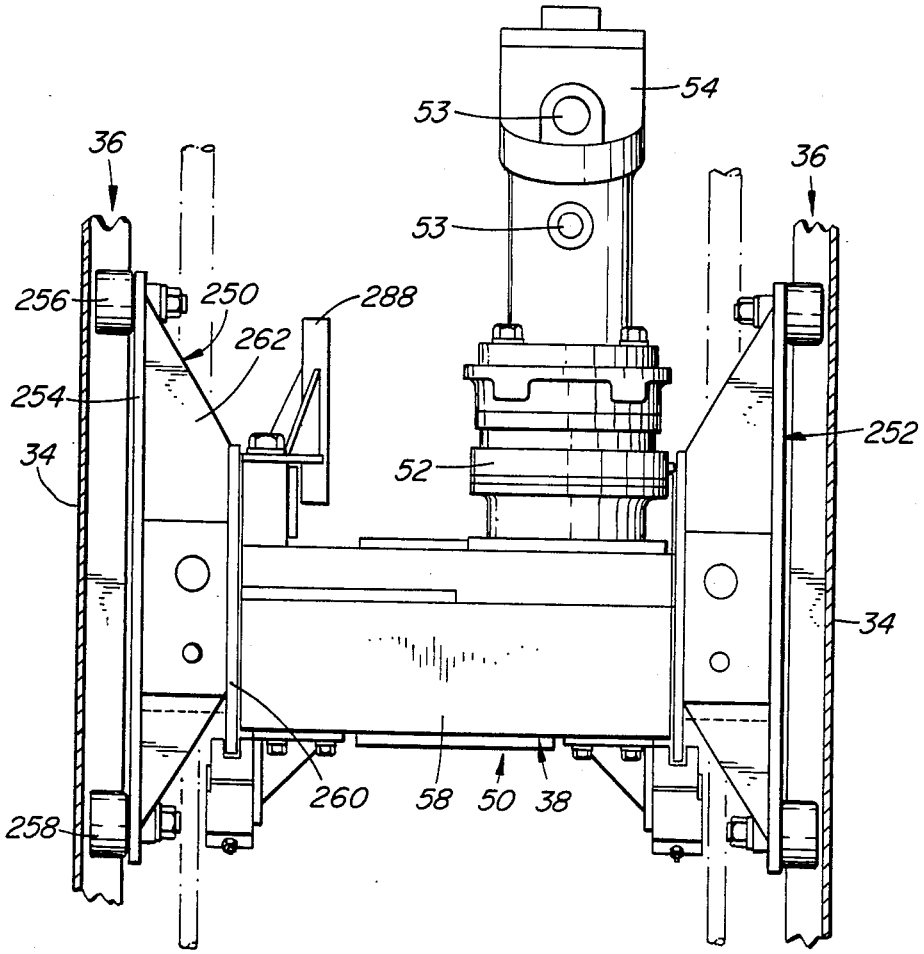
FIG. 4 is a rear elevational view of the assembly of FIG. 3.

The top drive 38, illustrated in FIGS. 3–6, is generally comprised of a transmission or gear box 50, a speed reducer 52, and a hydraulic motor 54. The speed reducer 54 is drivingly connected to the input shaft 56 of the gear box and bolted to the gear box casing 58 while the hydraulic motor 54, which is preferably of the reversible, variable displacement type, is drivingly connected and bolted to the speed reducer 52, as shown in FIGS. 3 and 4. The motor is connected to hydraulic system 29 via appropriate conduits 53 (FIG. 4). The speed reducer and motor are of conventional construction and accordingly are neither illustrated nor described in detail herein.

Casing 58 is generally of box-shaped configuration and houses a drive pinion 60, which in the illustrated embodiment is integral with input shaft 56, a crown gear 62 which meshingly engages with pinion 60 and a tubular drive spindle 64 bolted to crown gear 62. As will be described more fully later, the drive spindle is adapted to removably receive and drive any one of several pipe engaging or coupling devices so that the top drive can be quickly and readily modified to drive pipe of different sizes and carry out functions other than driving the drill string including threadedly engaging and disengaging adjacent pipe sections and hoisting the drill string.

Figure 5:
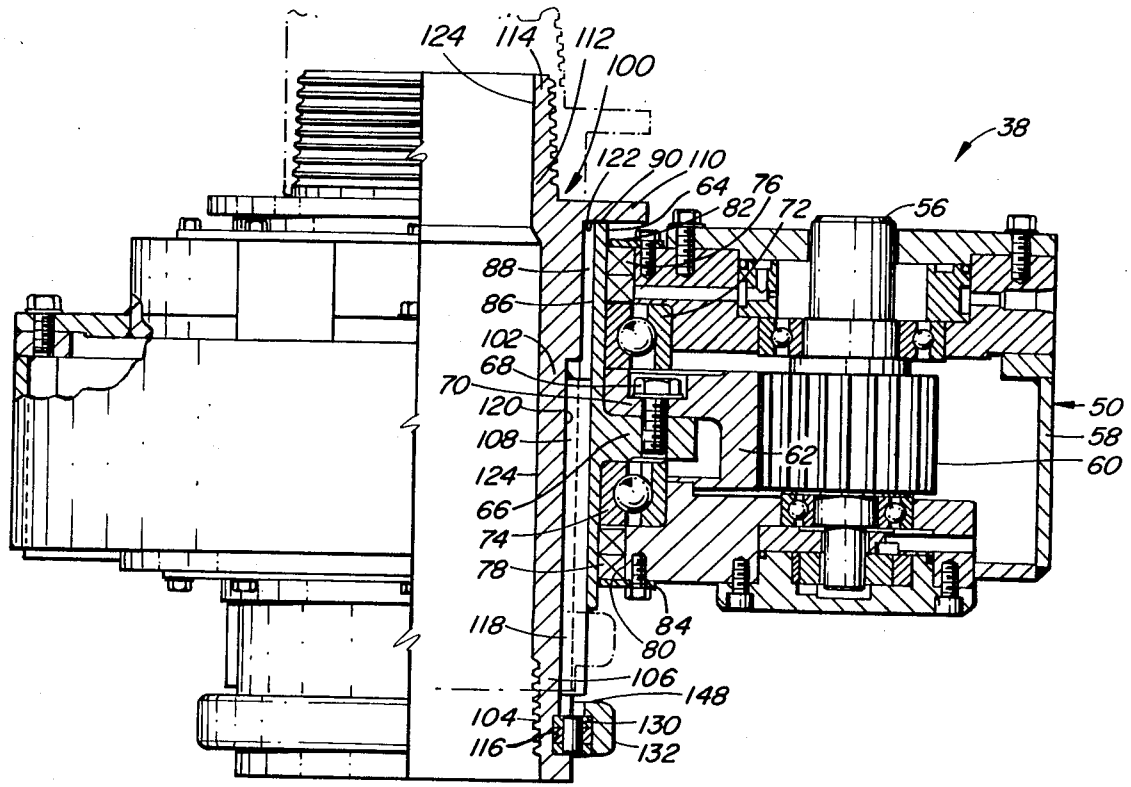
FIG. 5 is a partial cross-sectional view of a portion of the pipe drive mechanism.

Drive spindle 64 is formed with a radially outwardly extending flange 66 adjacent its midportion, which flange is abuttingly engaged with and secured by bolts 68 to a radially inwardly extending flange 70 of crown gear 62, as best shown in FIG. 5. The drive spindle 64 and crown gear 62 are rotatably mounted in the casing 58 by upper and lower ball bearing assemblies 72 and 74. Upper and lower oil seals 76 and 78 are disposed between each end of the drive spindle 64 and bore 80 of the casing 58 as shown in FIG. 5. The oil seals are protected and retained in position by upper and lower oil seal guard rings 82 and 84 bolted to casing 58.

Drive spindle 64 is also formed with a bore 86 which telescopingly and removably receives the pipe coupling devices. Bore 86 is formed with at least one, but preferably a plurality of longitudinally extending keyways 88. As will be explained later, upper annular edge 90 of spindle 64 serves to support the removable pipe coupling tools.

It will be seen that actuation of motor 54 effects rotation of shaft 56 and pinion 60 in one direction and rotation of crown gear 62 and spindle 64 in the opposite direction. Reverse rotation of the motor results in reverse rotation of the spindle and, inasmuch as the motor is of the variable displacement type, the spindle can be driven at various speeds and used for various purposes such as rotatably driving a drill string and making and breaking tool joints between adjacent pipe sections.

PIPE COUPLING TOOLS

Figure 11:
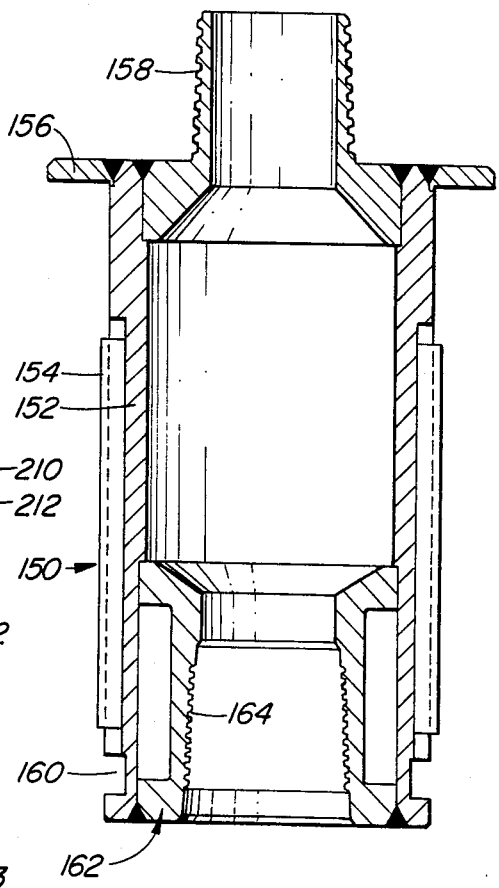
FIG. 11 is a cross-sectional view of a pipe drive tool similar to that illustrated in FIG. 5 but for use with smaller drill pipe.

FIGS. 5 and 7–11 illustrate pipe coupling devices or tools which form an important part of the present invention. The tool generally designated by reference numeral 100 in FIGS. 5 and 11 is used primarily for rotatably driving a drill string and threadedly engaging adjacent, axially aligned pipe sections. The tool generally designated by reference numeral 170 in FIGS. 7–10 is intended for use primarily as a break-out tool, i.e., for threadedly disengaging adjacent pipe sections. However, both tools can also be used for hoisting the drill string.

Drive tool 100 is generally comprised of a cylindrical body portion 102 having an internal thread 104 at its lower end 106, at least one, but preferably a plurality of longitudinal, equally spaced keys 108, and a radially outwardly extending flange 110 at its upper end 112. An externally threaded neck portion 114 extends axially from the upper end of tool 100. An external radially outwardly facing circumferential slot 116 is formed adjacent the lower end 106 of the tool.

Thread 104 is formed to threadedly receive one end of a cylindrical tool known as a "saver sub". A saver sub is generally a short length of pipe externally threaded at both ends and is normally used at locations where extensive threading and unthreading occurs. Thus, the relatively inexpensive saver sub takes most of the wear. The other end of the saver sub is threadedly received in the box end of a length of drill pipe. It will be understood that the lower end of the tool 100 could be formed with an external thread adapted to be connected directly to the box end of a drill pipe thereby obviating the need of a saver sub if so desired.

In the embodiment shown, the keys 108 are formed by welding elongated steel bars 118 in four elongated, longitudinal slots 120 formed on the outer cylindrical periphery of the tool 100. The keys are received in keyways 88 of drive spindle 64 and serve to transmit torque from the drive spindle 64 to the body portion of the tool. The term axial splines used hereinafter is intended to refer to any arrangement which non-rotatably couples two components while permitting relative axial movement therebetween.

Flange 110 defines a radial annular shoulder 122 which abuttingly engages upper annular edge 90 of spindle 64. Thus, the tool is thereby vertically supported in the top drive by the spindle 64. Tn addition to serving as the means of supporting the tool in the top drive, the flange serves as a "flinger"—a means whereby contaminants, such as dirt, are centrifugally propelled away from the upper oil seals 76.

Figure 5A:
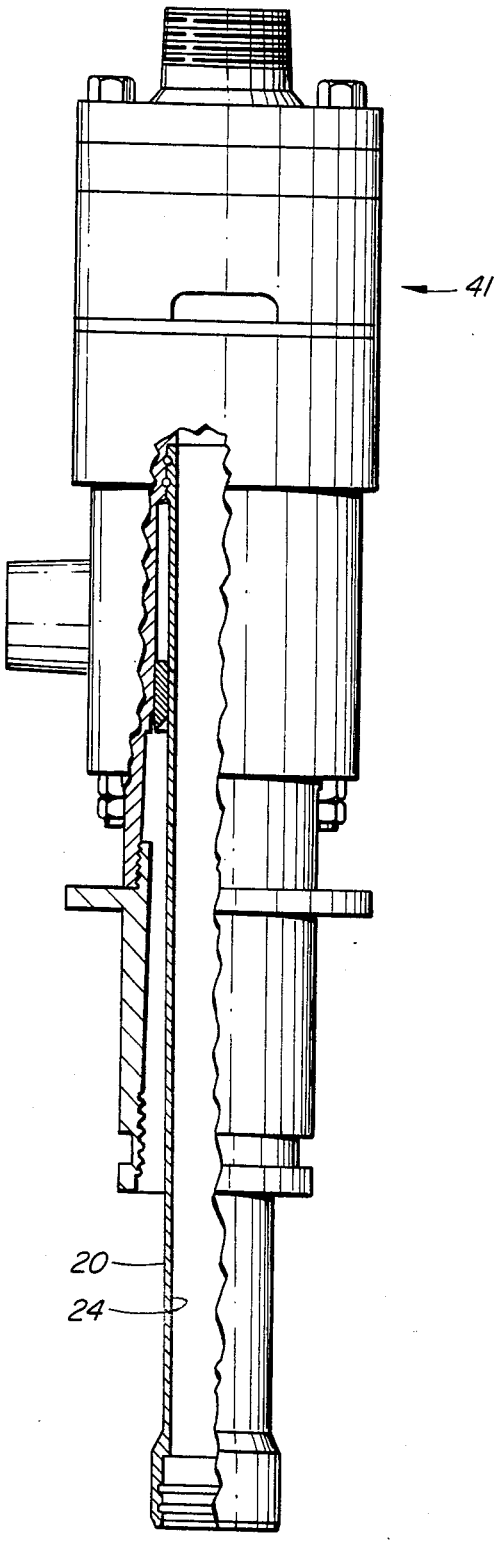
FIG. 5*a* is a partially broken elevational view of an air swivel discharge device connected to a coupling tool and the inner pipe member of a dual-wall drill pipe.
Figure 6:
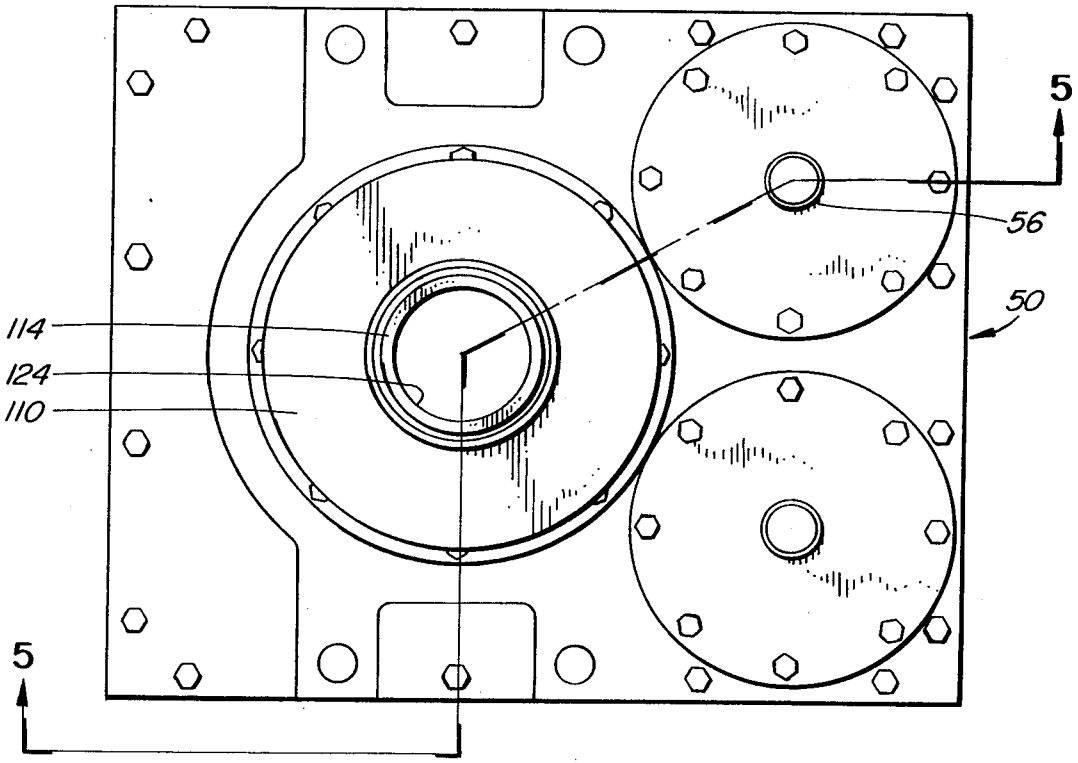
FIG. 6 is a partially broken top view of the pipe drive mechanism illustrated in FIG. 5.

Threaded neck portion 114 is adapted to be threadedly connected to an air discharge swivel 41, as illustrated in phantom in FIG. 5*a*. The neck 114 defines an opening 124 to receive an inner pipe section, as also shown in FIG. 5*a*, which is sealingly connected to the air discharge swivel and provides an annular passageway between the inner pipe and opening 124 for communicating air to passageway 22. As explained earlier, an air discharge swivel is a device for connecting a supply of air to annular passageway 22 and bore 24 of the inner pipe to an exhaust conduit which, in turn, is connected to a cyclone 43 for separating air from cuttings while the drill string rotates. Air swivel discharge devices are well known and therefore are not described in detail herein. In practice, pipe coupling tool 100 remains connected to the air discharge swivel unless a tool for use with a different sized pipe is required. In such case, the tool is simply threadedly removed and the desired tool is threaded onto the air discharge swivel.

A split thrust ring 130 and a retaining ring 132 are provided for preventing inadvertent removal of the drive tool 100 and for limiting longitudinal or axial travel of the tool 100 relative to the top drive. As will be described in greater detail later, such movement is desirable when threadedly engaging adjacent lengths of pipe.

Figure 12:
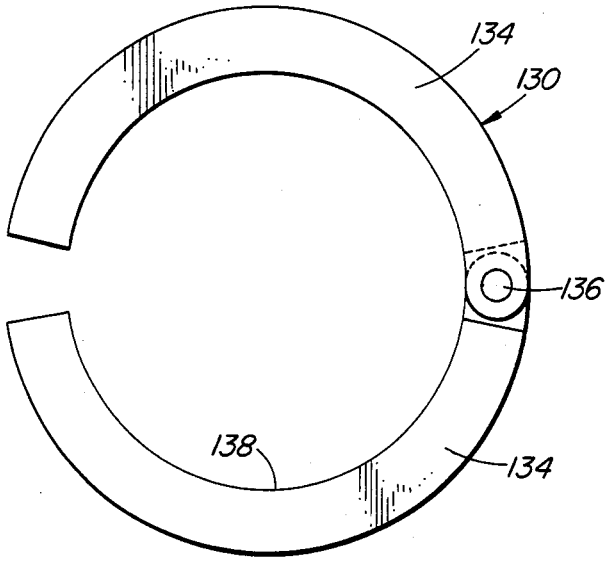
FIGS. 12 and 13 are a top and edge view, respectively, of a split ring for use in retaining a pipe engaging tool on the top drive.
Figure 13:
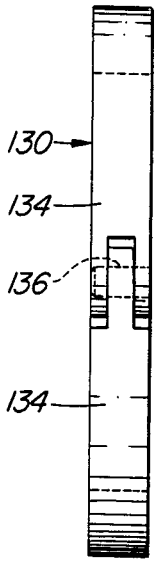

As shown in FIGS. 12 and 13, split ring 130 is comprised of a pair of arcuate arms 134,134 connected at one end for pivotal movement about a pin 136. In the position shown in FIG. 13, arms 134,134 define a cylindrical surface 138 whose diameter is slightly larger than the inner diameter of peripheral slot or groove 116 of tool 100. Thus, ring 130 is adapted to be fitted into the slot 116 and is readily removable therefrom by pivotally manipulating arms 134,134.

Figure 14:
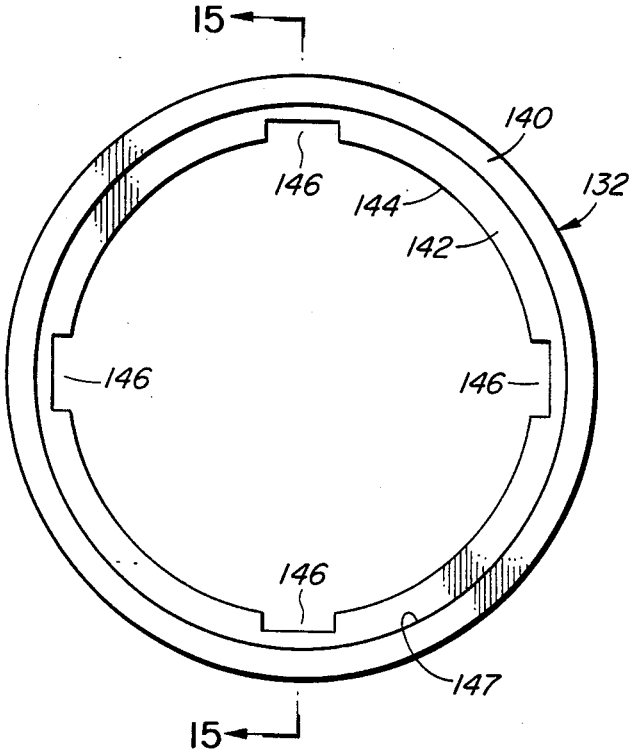
FIGS. 14 and 15 are a top and cross-sectional view taken along line 15—15, respectively, of a thrust retainer ring associated with the split ring.
Figure 15:
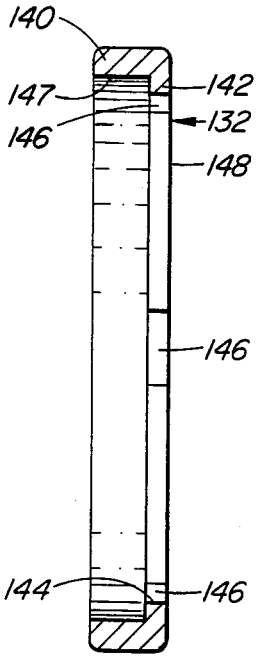

Retaining ring 132, shown in FIGS. 14 and 15, is provided to prevent separation of arms 134,134 of the split ring yet permit quick removal of the split ring from the tool and the tool from the top drive. Ring 132 is formed with a skirt portion 140 and an annular shoulder portion 142. Shoulder portion 142 defines axial opening 144 which telescopingly receives body portion 102 of tool 100. Opening 144 is formed with four keyways 146 for slidingly receiving keys 108 of the tool. The skirt portion 140 is formed with an opening 147 sized to loosely receive the outer periphery of split ring 130 as shown in FIG. 5. The retainer ring 132 is maintained in the position shown in FIG. 5 by gravity.

Thus, in order to remove the drive tool from the top drive, retaining ring 132 is telescopingly moved upwardly, as viewed in FIG. 5, the split ring 130 is removed from slot 116 by opening or separating arms 134,134, and ring 132 is slid downwardly and away from the tool. The tool (and its associated air discharge swivel) is then free to be removed from the top drive by moving it axially upwardly and outwardly of the drive spindle. The reverse procedure is adopted to operatively locate a tool in the top drive.

The distance between the shoulder 122 of the drive tool 100 and the upper surface 148 of ring 132 is arranged to be longer than the axial length of the drive spindle 64 by an amount at least equal to the length of the thread of the box (or pin) of a drill pipe. This avoids the need of incrementally lowering the top drive when the top drive is used to thread an additional pipe section to the drill string in a manner to be described later. However, it is pointed out that during such procedure, assuming a length of pipe has been mounted on the saver sub attached to the drive tool and the pin end of the drill pipe has been aligned with and brought into abutting engagement with the box end of the upper pipe of the drill string, the top drive is lowered until the lower end of the drive spindle 64 abuts surface 148 of ring 132. Then, the drive spindle 64 is rotated in a clockwise direction (viewed downwardly in FIG. 5). Such rotation threadedly engages the pin of the pipe being added to the upper box of the drill string. As this occurs, the pipe being added and the drive tool move downwardly relative to the top drive so that no vertical adjustment of the position of the top drive is required during this operation.

Coupling tool 150 illustrated in FIG. 11 is in all material respects the same as that illustrated in FIG. 5 except that it is constructed for use with drill pipe of smaller outside diameter. Specifically, the body portion 152, keys 154, annular flange 156, neck portion 158 and peripheral slot 160 are identical to those of tool 100 so that tool 150 cooperates with drive spindle 64 and split and retaining rings 130 and 132 in precisely the same manner as tool 100. However, an insert 162 replaces internal thread 104 of tool 100 and provides an internal thread 164 of smaller diameter than thread 104 for use with smaller drill pipe. As shown, insert 162 is welded to the body portion.

It will be understood that in addition to transferring torque to the drill string, the above described coupling tools can be used to transmit axial forces to the drill string in situations where hoisting effort is required. Thus, should the drill string become jammed, as sometimes occurs, the carriage actuating mechanism is actuated so as to apply a vertical force to the carriage which force is transmitted to the top drive casing. The force is in turn transmitted to the drive spindle, via the ball bearing assemblies and then to the drive tool flange, body portion and drill pipe.

Figure 7:
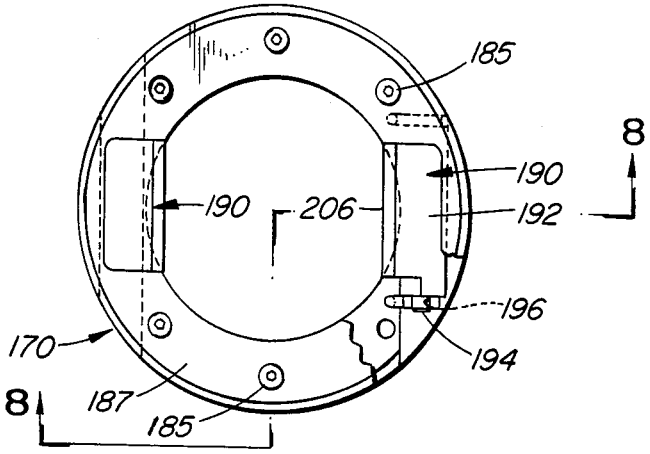
FIG. 7 is a top view of a pipe engaging tool used for dismantling or "breaking" a pipe joint.
Figure 8:
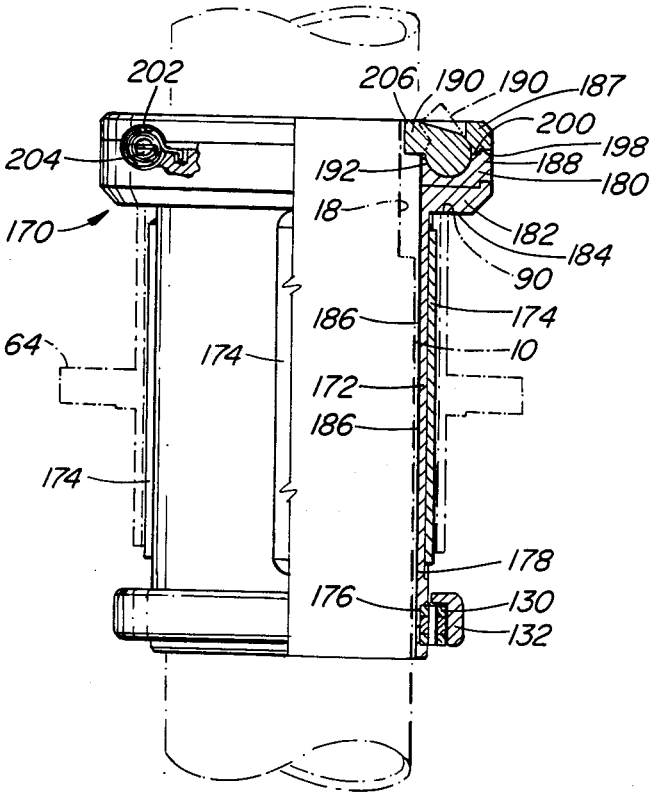
FIG. 8 is a cross-sectional view taken along line 8–8 of FIG. 7.

FIGS. 7 and 8 illustrate a "break-out" tool 170 intended for use in threadedly disengaging two pipe sections and, hoisting the drill string in the event that additional hoisting effort is required to release a jammed drill string.

Break-out tool 170 is constructed so as to be received in and rotatably driven by drive spindle 64 in the same manner as drive total 100. Thus, tool 170 is formed with a tubular body portion 172 having four equally spaced keys 174 and a peripheral slot 176 adjacent lower end 178 thereof for reception of split ring 130 and retaining ring 132. The upper end 180 is formed with a flange 182 having an annular shoulder 184 for abutting engagement with upper edge 90 of drive spindle 64 and application of an upward thrust to the tool when required. As with tools 100 and 150, the length of tool 170 is such so as to permit axial travel of the tool relative to drive spindle 64 and thereby avoid the need of incrementally raising the top drive as a pipe section is unthreaded. Further, tool 170 is mounted on and removed from the drive spindle 64 in precisely the same manner as tools 100 and 150.

The body portion is formed with an axial bore or opening 186 adapted to telescopingly receive a length of pipe section as shown in dotted lines in FIG. 8.

Secured to flange 182 by bolts 185 are a pair of concentric annular discs 187 and 188 between which are confined a pair of diametrically opposed dogs 190. Each dog 190 is formed with a cylindrical portion 192 from the opposite ends of which extend stub shafts or pins 194 received for pivotal movement in blind bores 196 formed in abutting surfaces 198 and 200 of discs 187 and 188 respectively. Also formed in discs 187 and 188 adjacent each bore 196 are chambers 202 which receive torsion or spiral springs 204 which serve to bias dogs 190 toward the solid line position shown in FIG. 8.

Extending radially outwardly and longitudinally of each dog 190 is a jaw portion 206 adapted to be received in previously mentioned pin end break-out slots 18 of a pipe section as shown in FIG. 8.

Figure 9:
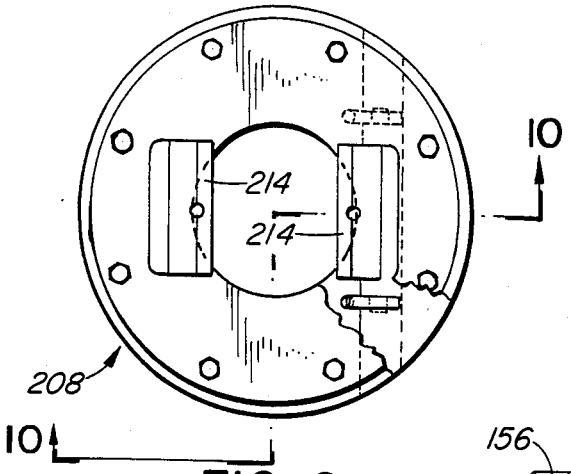
FIGS. 9 and 10 are views similar to FIGS. 7 and 8 respectively but illustrating a tool for use with a smaller size of pipe.
Figure 10:
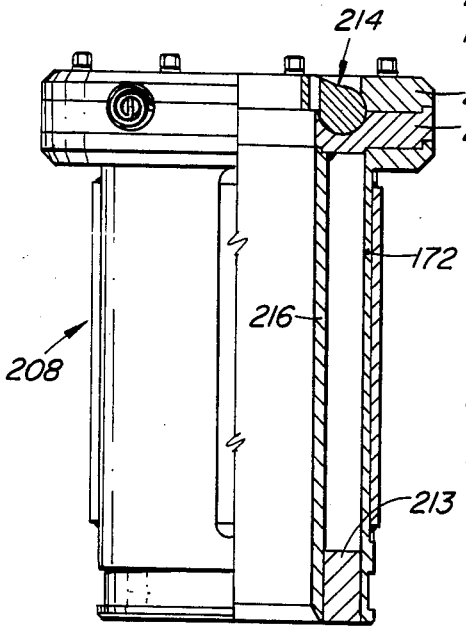

The break-out tool 208 illustrated in FIGS. 9 and 10 is in all material respects the same as the tool illustrated in FIGS. 7 and 8 except that it is used with a pipe section of smaller outside diameter. This tool utilizes the same tubular body portion 172 but discs 210 and 212 having a smaller inside diameter and locating the dogs 214 closer together are utilized. In addition an inner cylindrical tube 216 is concentrically disposed within the tubular body position. As shown, the upper end of the inner tube is welded to the lower disc 212 while a spacer block 213 is disposed between the lower end of the inner tube 216 and the body portion 172.

When it is desired to remove the drill string from the bore hole, the drive tool 100 and air discharge swivel 43 are removed from the top drive in the manner previously explained and the break-out tool 170 is operatively positioned on the top drive as also previously explained with respect to drive tool 100. The carriage actuating mechanism is then actuated to lower the carriage, and hence the top drive, to a position adjacent the bottom of the mast. It will be understood that the top drive will remain in this position during the break-out operation unless the hoist mechanism is incapable of raising the drill string in which case the carriage actuating mechanism is used to provide additional vertical thrust.

It will also be understood that the break-out wrench has been engaged with the box end break-out slots 16 of the uppermost pipe section of the drill string and supports the drill string, at least in part. So arranged, the rig is ready for the break-out operation.

A hoist plug, secured to the free end of a cable connected to the hoist mechanism to be described in greater detail later, is passed through the break-out tool bore 186 and threaded into the box end of the uppermost pipe section of the drill string. The hoist mechanism is then actuated slightly so as to remove the weight of drill string from the break-out wrench and the wrench is retracted. The hoist mechanism is thereafter actuated to raise the drill string the length of a pipe section. As the drill string is raised, the periphery of the drill pipe surface pivots the dogs 190 to the dotted line position shown in FIG. 8 against the bias of torsion springs 204. Once the pin end break-out slots 18 reach dogs 190, the dogs snap into the slots to the solid line position shown in FIG. 8 assuming the slots are properly angularly aligned with the dogs. If not, the break-out tool and drill pipe are rotated slightly by actuating the top drive. The hoist mechanism is then lowered slightly until the upper flattened surface 206 of the dogs engage the upper transverse edges 210 of slots 18. This vertically aligns the box end break-out slots of the next pipe section with the break-out wrench which is then extended to engage such slots. It may be necessary to rotate the drill string by actuating the top drive in order to angularly align the box end break-out slots with the wrench. Once so engaged, the wrench prevents rotation of the drill string.

The top drive is then reversely rotated thereby reversely rotating the uppermost pipe section, via drive spindle 64 and break-out tool 190. As the upper pipe section is rotated, its pin unthreads from the box of the next lower pipe section and the pipe moves upwardly under the influence of the threads as well as that of a spring mechanism associated with the hoist mechanism. Further, dogs 190 move relatively downwardly in the pin end break-out slots 18 and thus slots 18 must be of sufficient length to accomodate such movement.

Once the upper pipe section has been separated from the next pipe section, the hoist mechanism is actuated to raise the separated pipe section free of the top drive. The hoist is then actuated to lower the pipe section which is placed in a pipe rack 47 (FIG. 2) disposed adjacent the drill rig. The hoist plug is removed from the pipe section and the operation is repeated until the drill string is completely dismantled.

THE MAST

As shown in FIG. 2, the mast 32 is an elongated parallelepiped structure defined by two rear tubular steel corner posts 230, two front posts 232 constructed of channel members, whose open sides face one another and define track 34, and intermediate tubular steel braces 234. The mast is also formed with a base 236 and a crown 238.

As also shown in FIG. 2, the mast is disposed in an upright position during use. However, the mast is adapted to be pivoted to a horizontal position during transport on sled or skid 27. This is achieved by a pair of outwardly projecting pins 242 welded or otherwise secured to a brace member 234, as shown. The pins 242 are received in cradles 244 of support posts 246 associated with sled 27. A support bracket 248 supports the upper end of the mast during transport and a wedge lock at the base of the mast will maintain the mast in its upright position during use.

THE CARRIAGE

The carriage 36 is comprised of two sections 250 and 252 which are mirror images of one another. Section 250 is associated with and supports the left side of the top drive and while section 252 is associated with and supports the right side of the top drive. While the following description is referrable to section 250, it is to be understood that the description is equally applicable to section 252.

With reference to FIGS. 3, 4, 16 and 17, carriage section 250 includes an elongated outer plate 254 having rollers 256 and 258 rotatably mounted at its opposite ends. Rollers 256 and 258 are disposed for movement within the channel shaped members defining track 34. Spaced laterally inwardly of plate 254 is an inner plate 260 connected to plate 254 by laterally extending, spaced connector plates 262,262. Inner plate 260 is formed with an arcuate, rearwardly extending detent plate 264 having an arcuate guide surface 266 and recesses 268 and 270 spaced approximately 90° apart.

Extending between plates 254 and 260 is a pivot pin 272 having an inwardly disposed head 274. The opposite end of pin 272 is welded or otherwise secured to plates 254 and 260. Pin 272 extends inwardly beyond inner plate 260 and defines between plate 260 and head 274 a journal portion received in a two part support and pivot block 276 bolted to the casing of the top drive. Thus, the top drive is supported for pivotal movement about the axis of pins 272 between a first and a second position. In the first position, illustrated in FIGS. 3 and 4, the rotary axis of drive spindle is vertically disposed and the top drive may be used for the previously described operations. The second position of the top drive facilitates the addition of lengths of pipe to the top drive. In this position, the top drive is disposed about 90° about the axis of pins 272 from the first position with the underside of top drive facing away from the mast. When so disposed a length of pipe section may be threaded onto the saver sub attached to the drive tool by either manually rotating the pipe or slowly rotating the top drive.

Figure 16:
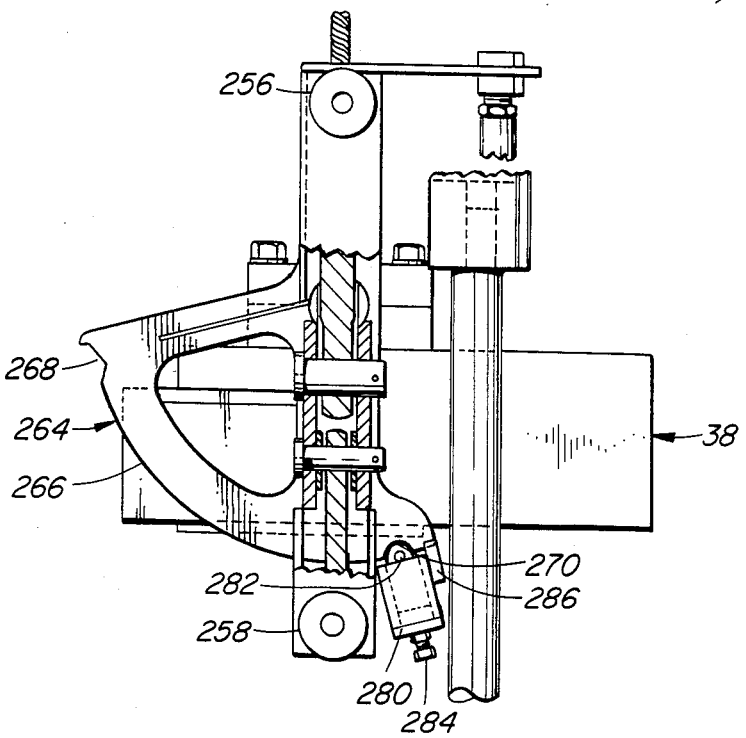
FIG. 16 is a side, partially cross-sectional view of the carriage.

Secured to the underside of the top drive casing is a detent roller assembly 280 which houses a spring biased roller 282 (FIG. 16). Roller 282 engages guide surface 266 of detent portion 264 of plate 260. Recesses 268 and 270 define the first and second positions respectively of the top drive. The load of the spring within detent roller assembly 280 may be adjusted by nut 284.

A torque and guide member 286 engageable with detent roller assembly 280 positively locates the top drive in the first position.

Secured to one of the pivot blocks 276 is an air swivel torque slide 288 for preventing rotation of the outer housing of the air discharge swivel.

CARRIAGE ACTUATING MECHANISM

Figure 19:
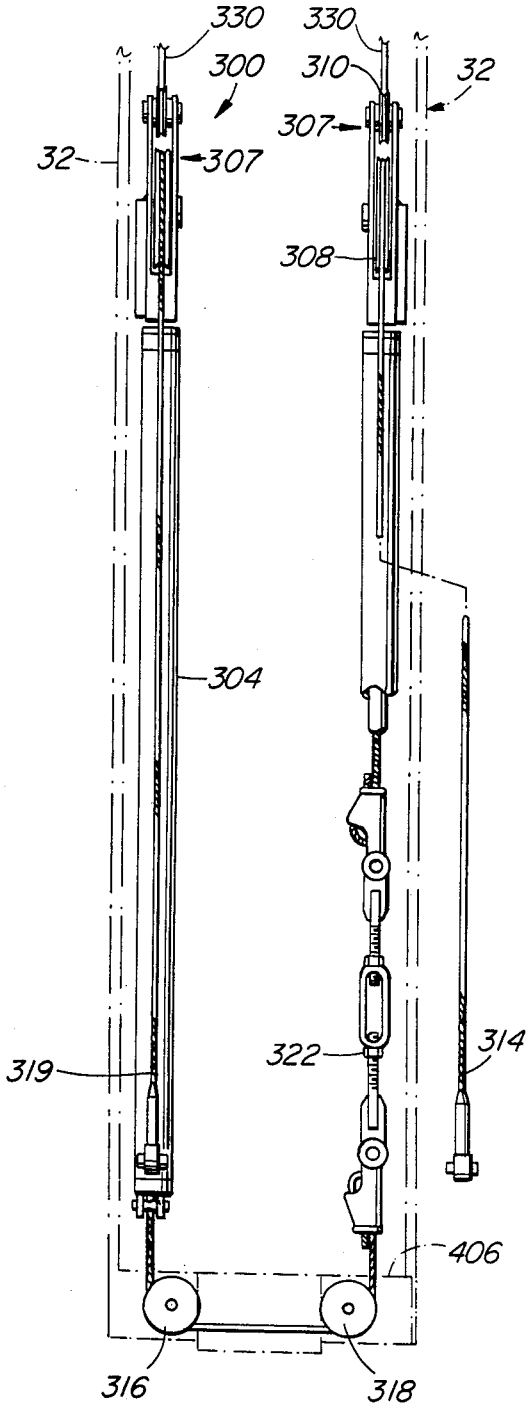
Figure 20:
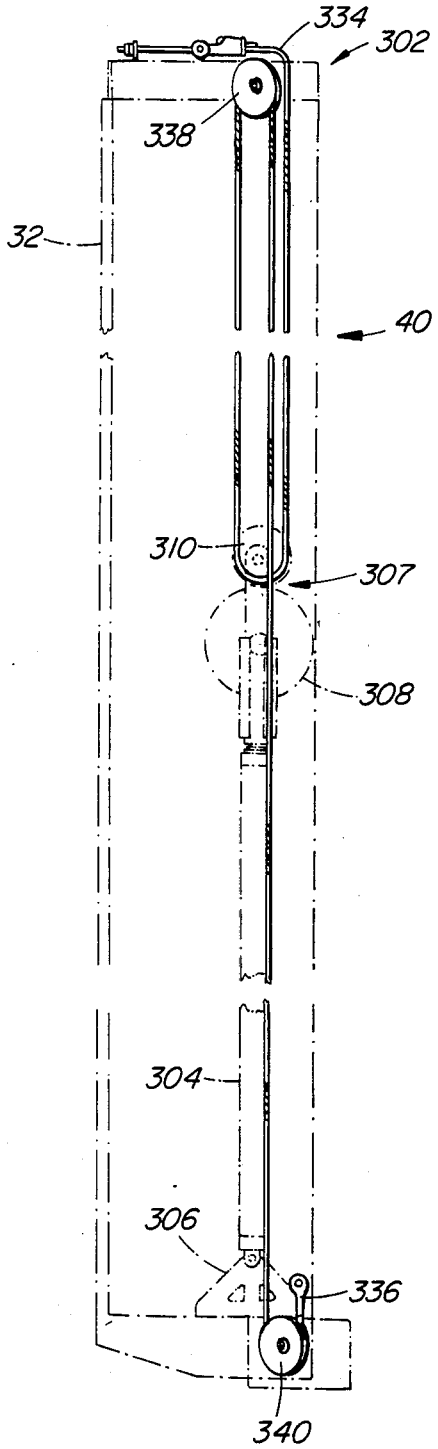
FIGS. 20 and 21 are views similar to FIGS. 18 and 19 but illustrating a carriage actuating mechanism pull-down assembly.
Figure 21:
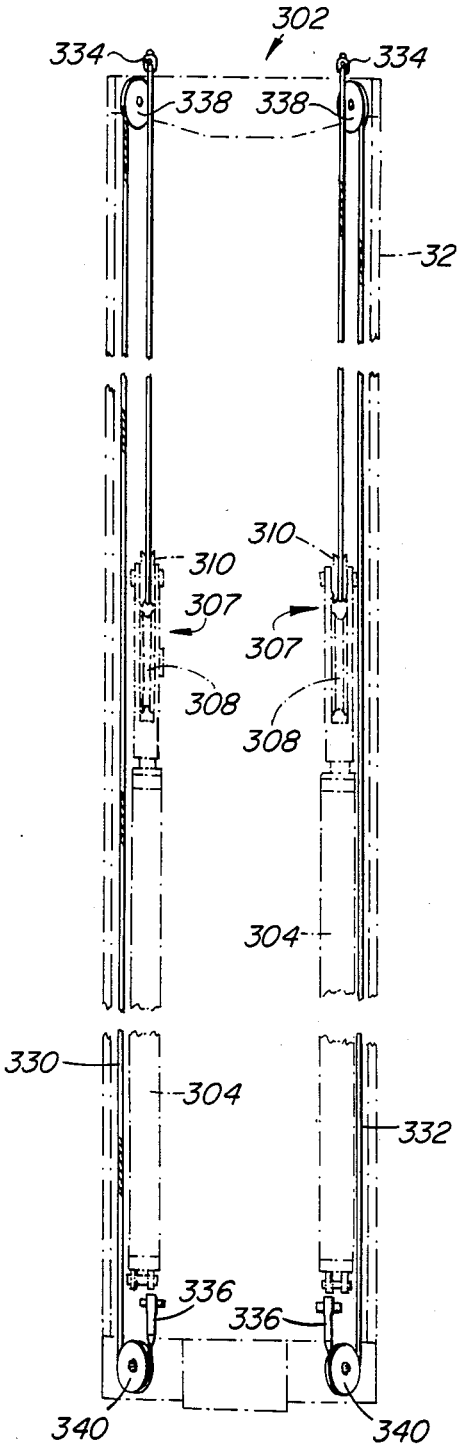

The carriage actuating mechanism 40 is comprised of a "pull-up" assembly 300 (FIGS. 18 and 19) and a "pull-down" assembly 302 (FIGS. 20 and 21). Both assemblies are actuated by the same two hydraulic cylinders 304,304 vertically disposed on laterally opposed sides of the mast 32. The two cylinders are secured to the base of the mast by a support bracket 306 (see FIGS. 18 and 20). Attached to the free end of the piston rod of each cylinder is a pulley assembly 307 having pulleys 308 and 310.

Figure 17:
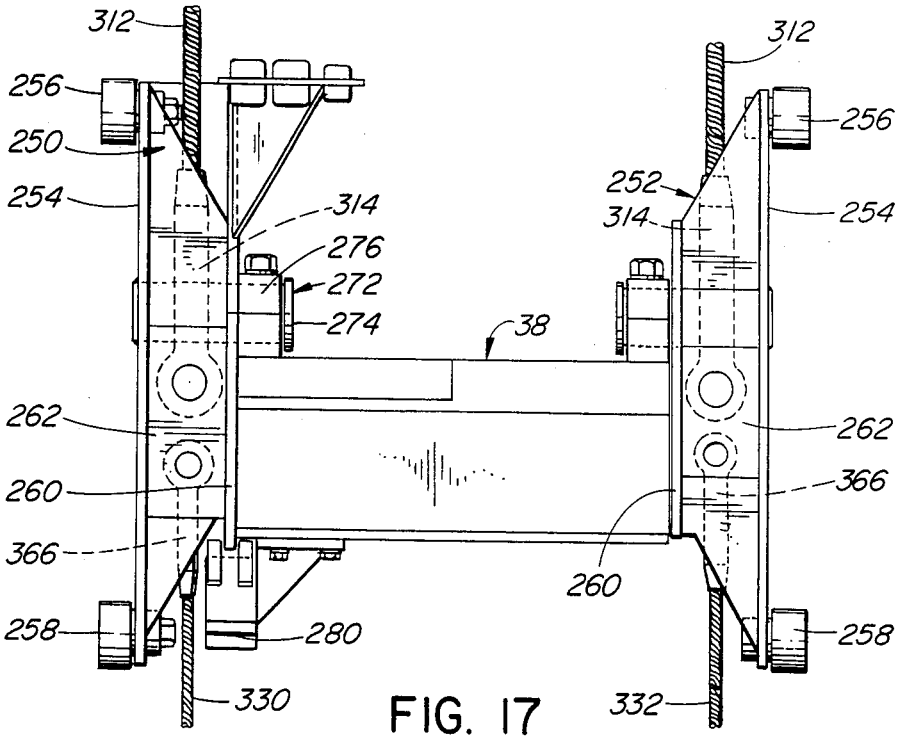
FIG. 17 is a front view of the carriage and top drive assembly.
Figure 18:
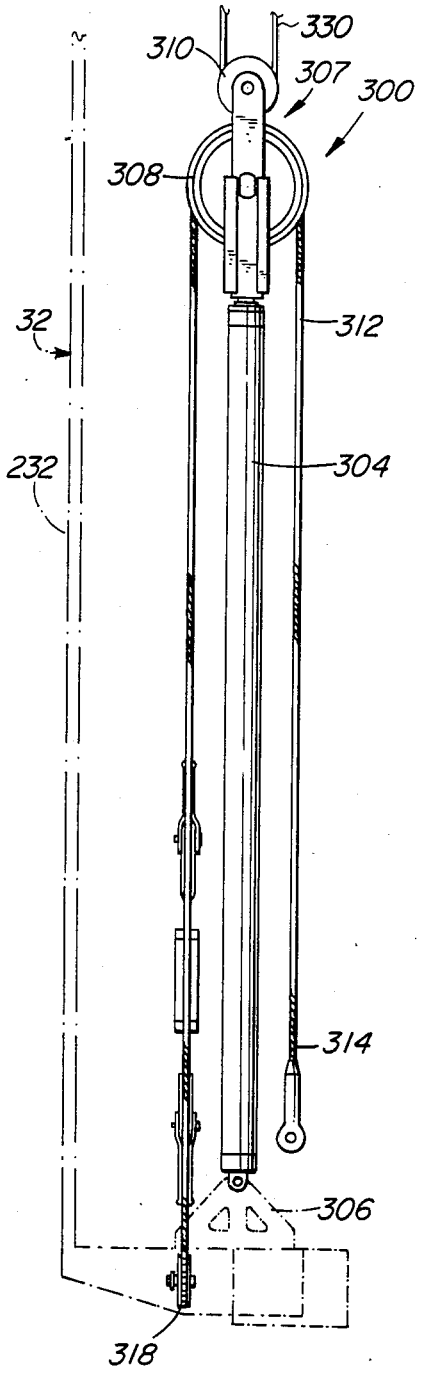
FIGS. 18 and 19 are side and front views, respectively, of a carriage actuating mechanism pull-up assembly showing the mast in dotted and dashed lines.

With reference to FIGS. 18 and 19, the pull-up assembly includes a cable 312 having one end 314 secured to one section of the carriage in the manner shown in FIGS. 16 and 17. Cable 312 is trained about pulley 308 of one pulley assembly 307, pulleys 316 and 318 (FIG. 19) rotatably mounted in the mast base, and pulley 308 of the other pulley assembly 307. The other end 319 of cable 312 is then releasably connected to the other section of the carriage as also shown in FIGS. 16 and 17. A turnbuckle 322 is provided for adjustably tensioning the cable.

Thus, it will be seen that when cylinders 304 are actuated in unison to extend the piston rods, the ends 314 and 319 of cable 312 will move upwardly and thereby apply a vertical thrust to the top drive. It will be noted that the top drive will move upwardly at twice the rate of the piston rods.

With reference to FIGS. 20 and 21, the pull-down assembly 302 is comprised of two cables 330 and 332 each associated in an identical manner with one of the hydraulic cylinders 304. One end 334 of each cable is adjustably and removably connected to the crown of the mast, as best shown in FIG. 20, while the other end 336 of each cable is removably secured to a respective section of the carriage, as shown in FIGS. 16 and 17.

From end 334, each cable extends downwardly and trained about upper pulley 310 of pulley assembly 307, upwardly and trained about pulley 338 rotatably mounted on the crown, and downwardly and trained about pulley 340 rotatably mounted in the mast base.

Thus, when cylinders 304 are actuated in unison to retract their respective piston rods, ends 336 of the cables 330 and 332 move downwardly and apply a downward thrust or force to the carriage and, hence, the top drive.

Two important features are to be noted. Firstly, it is known that the capacity of hydraulic cylinders is larger when its piston rod is extended than when it is retracted. In the present instance, the larger capacity of the cylinders is utilized for pulling up where higher capacity is required. Secondly, the hydraulic cylinders are mounted on the base rather than on the crown as is known. Thus, the mast need not absorb as much of a load and may therefore be made lighter, it being understood that weight is an important consideration in helicopter transportable drill rigs.

It will be understood that means is provided for vertically guiding the piston rods.

THE HOIST MECHANISM

The hoist or haul-out mechanism 42 is illustrated in FIGS. 22 and 23 and is comprised of a single inverted, vertically extending hydraulic cylinder 350 mounted on the mast crown adjacent the rear side 352 (remote from the top drive) of the mast. A pulley 354 is secured to the end of the piston rod 356 of the cylinder. A pivot head assembly 358 pivotally mounted atop the mast crown, as shown in FIG. 23, is comprised of a pair of spaced arms 360 connected at one end 362 to the crown and centrally supported by a compression spring assembly 364. A stop 363 is provided to limit downward travel of the assembly. A pair of pulleys 366 and 368 are rotatably mounted on arms 360 as shown.

A cable 370 has one end 372 connected to the crown and its intermediate portion trained about pulleys 354, 366 and 368. The other end 374 of the cable 370 is fitted with a hook (not shown) or the like for connection to a hoist plug 376 or a bail (not shown) secured to the upper end of the air discharge swivel.

The pivot head assembly 358 is provided to maintain cable 370 in tension during the break-out operation as well as maintain an upward force on the pipe section being removed without incrementally raising the hoist mechanism.

Figure 24A:
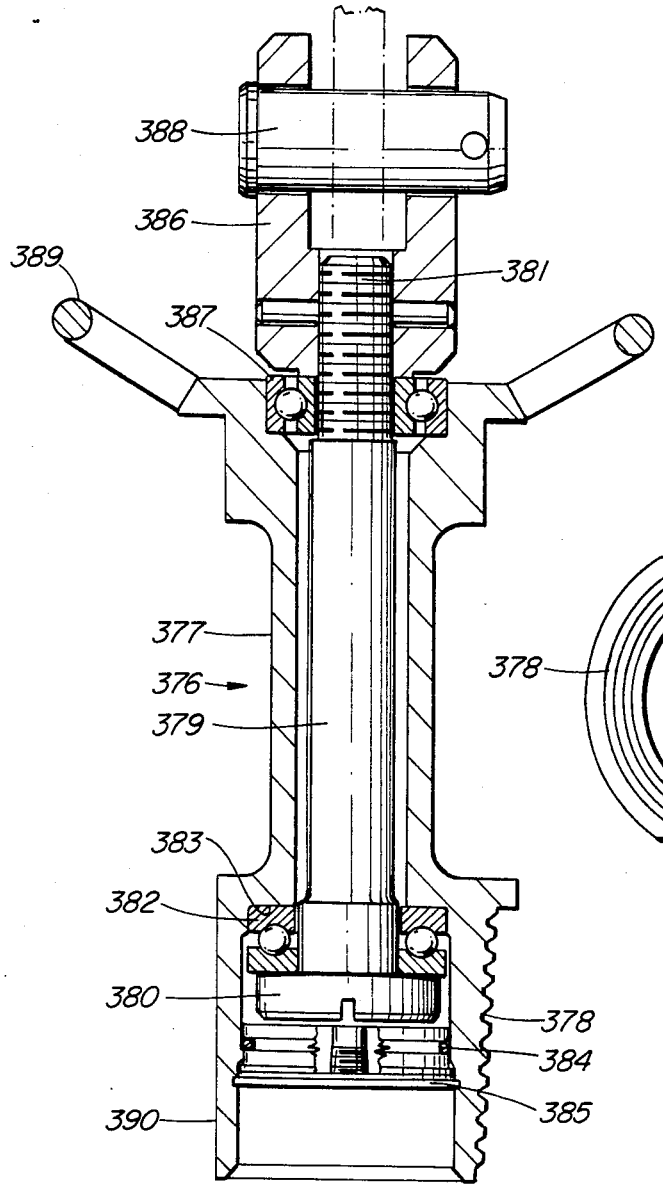
FIG. 24*a* is a longitudinal cross-sectional view of a hoist plug for use in elevating a drill string.
Figure 24B:
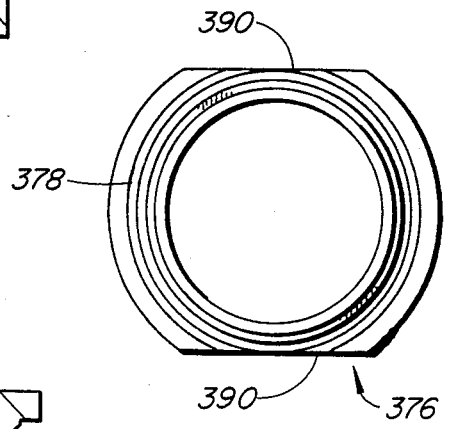
FIG. 24*b* is a bottom view of the hoist plug of FIG. 24*a;*

Hoist plug 376 is illustrated in FIGS. 24*a* and 24*b* and is comprised of a tubular body portion 377 having an externally threaded lower end portion 378 which is threadedly engageable with the box end of a drill pipe section. A shaft 379 having a head 380 at its lower end and a thread 381 at its upper end is disposed in body portion 377. Head 380 bears against a thrust bearing 382 which in turn bears against an internal shoulder 383 in the plug body. An oil seal 384 and retaining ring 385 close the lower end 378 of the plug. A clevis 386 is threaded onto upper end 381 of shaft 379 against a ball bearing 387. A removable clevis pin 388 is mounted in the clevis as shown for securing the end 374 of cable 370 to the hoist plug. The body portion is formed with a spoked, ringed handle 389 at its upper end for manually rotating the body portion with respect to the shaft. As best shown in FIG. 24*b*, threaded portion 378 is formed with a pair of opposed flattened surfaces 390 so that the lower end of the plug can be passed between the dogs 190 of a break-out tool 170 without moving the dogs.

Thus, when it is desired to use the hoist mechanism, end 374 of cable 370 is secured to clevis 386 and the lower end 378 of the plug is passed through bore 186 of tool 170 and threadedly engaged with the box of the uppermost drill pipe section of the drill string to be raised by rotating handle 389 and hence plug body 377. Cylinder 350 is then actuated to extend piston rod 356, and raise end 374 of cable 370, the hoist plug 376 and drill string. Once the upper drill pipe section of the drill string has been removed from the drill string and the top drive, piston rod 356 is retracted to lower the drill pipe section, the drill pipe section is unthreaded from the hoist plug section and placed in the pipe rack.

THE BREAK-OUT WRENCH ASSEMBLY

The break-out wrench assembly is illustrated in FIG. 25 which is a top view of the mast base. The assembly includes a wrench member 400 having a wrench head 402 and an elongated body portion 404. Wrench member is slidably mounted on the upper surface 406 of the mast base for reciprocation from a first extended position illustrated in FIG. 25 whereat the wrench is in engagement with a section of pipe and a second, retracted position whereat the wrench is clear of the drill string permitting rotation and/or axial movement of the latter.

Wrench head 402 is formed with a pair of opposed flattened surfaces 408 slidingly engageable with the box end break-out slots 16 of a pipe section. The wrench member is guided for reciprocal movement by a bracket 410 bolted to surface 406 and associated with body portion 404 and a pair of guides 412 secured to surface 406 and associated wing projections 414 extending from head 402. As shown in dotted lines in FIG. 25, a bar 416 secured to body portion 404, extends through a slot 418 in surface 406 into the mast base and is connected to a hydraulic cylinder 420 disposed within the base. The wrench head is supported by a surface 422 of a pipe guide member 424 formed in the mast base.

OPERATION

ASSEMBLING DRILL STRING AND DRILLING

Initially, the carriage actuating mechanism 40 is actuated to move the top drive mechanism 38 to a convenient lower position on the mast. An air discharge swivel mechanism having an appropriate pipe coupling tool 100 or 150 attached thereto is inserted into the bore 86 in spindle 64. The split thrust ring 130 and retaining ring 132 are then assembled on the pipe coupling tool.

The top drive 38 is manually pivoted about pins 272 from its first position to its second position. The top drive is maintained in the second position by the detent assembly. It should be noted at this point that the pins 272 extend through or near the centroid of the top drive, speed reducer, motor and air discharge swivel so that relatively little effort is required to move the top drive between its two positions.

An appropriate cutting bit is connected to the down hole end of the first drill pipe and the box end of such pipe is threaded onto the saver sub extending from the drive tool either by manually rotating the drill pipe or rotating the top drive while the pipe section is held stationary.

The carriage actuating mechanism is actuated to raise the top drive to the upper end of the mast 32. As the top drive rises, the weight of the pipe overcomes the effort of the spring detent assembly and the pipe moves towards a vertical position. The stop 286 engages the detent housing and thereby positively locates the top drive in its first, driving position.

The lower end of the pipe is placed above the pipe guide in the mast base and the carriage actuating mechanism is actuated to lower the top drive until the cutting bit engages the ground. The carriage actuating mechanism is deactivated and the rig is ready for drilling.

Motor 54 is actuated to begin the drilling operation. The drilling continues until the box end break-out slots 16 are vertically aligned with the break-out wrench. Hydraulic cylinder 406 is actuated to extend break-out wrench 400. The top drive is rotated if necessary in order to angularly align the box and break-out slots with the flattened surfaces 408 of wrench 400. Thus, the portion of the drill string in the bore hole is held against rotation. Motor 54 of the top drive is reversed so as to threadedly disengage the saver sub from the box of the drill pipe. Thereafter, the carriage actuating mechanism is activated to raise the top drive slightly. The top drive is then pivoted to its second position and is ready to repeat the foregoing procedure.

The mode of adding the second and subsequent pipe sections to the drill string is substantially the same as the mode of adding the first pipe.

A new length of pipe is threaded onto the saver sub as explained previously. The top drive is raised until the pin of the new pipe clears the box of the pipe already in place. The top drive is then lowered while the pin of the new pipe enters the box of the pipe already in place and the lower edge of the drive spindle abuttingly engages the upper surface 148 of retaining ring 132. The top drive is then rotated until the new pipe is fully threadedly engaged with the pipe already in place. It will be noted that as the new pipe is being threaded, it moves downwardly with respect to the top drive by virtue of the longitudinal clearance originally provided between the drive tool and the drive spindle so that it is not necessary to incrementally lower the top drive as the new pipe section is being threaded.

In the event that the drill string becomes jammed in the bore hole, the carriage actuating mechanism is actuated to apply an upward thrust to the drill strip via the top drive and coupling tool. Should the carriage actuating mechanism be incapable of raising the drill string, the hoist mechanism is attached to a bail (not shown) on the air discharge swivel or the top drive and it is actuated to apply an additional upward thrust to the drill string. Once the drill string is cleared, the hoist mechanism is disconnected and the top drive motor is activated to ream the bore hole and continue drilling.

DISASSEMBLING A DRILL STRING

When it is desired to remove the drill string from the bore hole, the break-out wrench is engaged with the box end break-out slots 16 of the uppermost pipe section of the drill string and the top drive is reversely rotated so as to disengage the saver sub from the box end of the uppermost pipe of the drill string. The top drive is then raised to a convenient position whereat the air discharge swivel and its accompanying pipe coupling tool 100 (or 150) are removed by removing split thrust ring 130 and retaining ring 132 as previously explained. Following this, a break-out tool 170 is inserted into the drive spindle 64 and the split thrust ring and retainer ring are assembled thereon so as to retain the break-out tool operatively disposed on the top drive.

The top drive is then lowered to a position adjacent the lower end of the mast. A hoist plug 380 is then secured to the end 374 of cable 370 of the hoist mechanism, extended through the opening in the break-out tool 170 and threadedly engaged with the threads in the box end of the uppermost pipe of the drill string. Thereafter, the hoist mechanism is actuated to raise the drill string slightly so as to move the weight of the drill string from the break-out wrench. The break-out wrench is retracted and the hoist mechanism is actuated to raise the drill string the length of a drill pipe. As this occurs, the drill string passes through axial bore 186 of the break-out tool and the dogs 190 are pivoted outwardly of bore 186 against the bias of spring 204. The drill string is raised until the box end break-out slots of the next pipe are vertically aligned with the break-out wrench and the dogs 190 are vertically aligned with the pin end break-out slots. As previously explained, it may be necessary to rotate the top drive so as to angularly align the dogs 190 and break-out wrench 400 with the pin end break-out slots 18 and box end break-out slots 16, respectively. At this point, it is to be noted that shoulder 184 of flange 182 of break-out tool 170 abuttingly engages annular surface 90 of drive spindle 64 and the dogs 190 are disposed at the upper end of the longitudinally elongated pin and break-out slots. Additionally, the compression spring assembly 364 of pivot head assembly 358 of the hoist mechanism are compressed and upwardly bias the drill string. Thus, as the top drive is reversely rotated, the upper drill pipe is unthreaded from the drill string and moves upwardly both under the influence of the action of unthreading and the bias of the compression spring assembly. Further, it will be noted that dogs 190 move relatively downwardly of the pin end break-out slots and the break-out tool moves axially upwardly relative to the top drive. As previously explained, incremental vertical adjustment of the top drive is not necessary.

Once the upper drill pipe has been completely unthreaded, the hoist mechanism is retracted and the decoupled pipe is placed in the pipe rack. The above described procedure is then repeated until the drill string is fully dismantled.

The embodime:nts of the invention in which an exclusive property or privilege is claimed are defined as follows:

1. A drill pipe coupling tool adapted to be removably mounted in a rotary drive mechanism of an earth drilling apparatus for coupling a drill pipe to said drive mechanism, said tool comprising:

a cylindrical, tubular body portion defining a rotary axis;

coupling means on said body portion for non-rotatably coupling said tool to a length of drill pipe for rotation of said tool and said drill pipe about said rotary axis;

axial spline means on the outer periphery of said body portion for engagement with mating spline means in said drive mechanism, said spline means non-rotatably coupling said tool to said drive mechanism for rotation of said tool about said rotary axis and permitting axial travel of said tool relative to said drive mechanism during operation of said drive mechanism;

means on said body portion for limiting axial travel of said tool between predetermined limits, said travel limiting means including retaining means removably mounted at one end of said tool, said retaining means being abuttingly engageable with said drive mechanism for limiting in one direction axial travel of said tool relative to said drive mechanism;

said travel limiting means including a radially outwardly facing groove in the outer periphery of one end of said body portion, said retaining means including a split ring having a pair of arcuate arms pivotally connected at adjacent ends and removably receivable in said groove and a retaining ring telescopically movable along the outer periphery of said body portion between a first position engaging said split ring and preventing separation of said arms and a second position permitting separation of said arms and removal of said split ring from said groove.

2. A coupling tool as defined in claim 1, said travel limiting means including first shoulder means extending outwardly of the other end of said body portion for abutting engagement with a portion of said drive mechanism.

3. A coupling tool as defined in claim 2, said shoulder means being a radially outwardly extending flange.

4. A drill pipe coupling tool adapted to be removably mounted in a rotary drive mechanism of an earth drilling apparatus for coupling a drill pipe to said drive mechanism; said tool comprising:

a body portion defining a rotary axis;

first coupling means on said body portion for non-rotatably coupling said tool to a length of drill pipe for rotation of said tool and said drill pipe about said rotary axis;

second coupling means on said body portion for non-rotatably coupling said tool to said drive mechanism for rotation of said tool about said rotary axis; and means for removably maintaining said tool operatively positioned on said drive mechanism, said maintaining means including a flange extending radially outwardly of one end of said body portion for abutting engagement with a first portion of said drive mechanism and removable retaining means moutned at the other end of said body portion for engagement with a second portion of said drive mechanism remote from said first portion.

5. A coupling means as defined in claim 4, said maintaining means permitting axial travel of said tool relative to said drive mechanism during operation of said drive mechanism.

6. A coupling tool as defined in claim 5, said first coupling means including thread means.

7. A coupling tool as defined in claim 6, further including an axial opening extending through said body means, said thread means being formed at one end of said opening.

8. A coupling tool as defined in claim 5, further including an axial opening extending through said body portion, said first coupling means including at least one pair of dogs mounted at one end of said body portion on diametrically opposed sides of said opening, each said dog being pivotable between a first position whereat a portion of said dog extends into said opening for engagement with a flattened recess of a drill pipe telescopically disposed in said opening for non-rotatably coupling said pipe to said tool and a second position whereat said dog is disposed exteriorly of said opening permitting axial and rotary movement of said drill pipe relative to said tool.

9. A coupling tool as defined in claim 8, each said dog being resiliently biased towards said first position.

10. A drill pipe coupling tool adapted to be removably mounted in a drill pipe rotary drive mechanism of an earth drilling apparatus, said mechanism having a drive member having a coupling tool receiving opening defining a rotary axis and shoulder means at each end of said opening, said tool comprising:

a tubular cylindrical body portion defining an axial drill pipe receiving opening and being telescopingly receivable in said tool receiving opening;

first coupling means on said body portion for non-rotatably coupling said tool to a drill pipe for rotation of said tool and said drill pipe about said rotary axis;

second coupling means on said body portion for non-rotatably coupling said tool to said drive member and permitting axial travel of said tool relative to said drive member during operation of said drive member;

flange means extending radially outwardly of one end of said body portion, said flange means being abuttingly engageable with said shoulder means at one end of said drive member for limiting axial travel of said tool in one direction; and retaining means at the other end of said body portion and being operable to permit telescopic insertion and removal of said tool in said tool receiving opening and being engageable with said shoulder means at the other end of said drive member for limiting axial travel of said tool in the direction opposite said one direction during operation of said drive mechanism.

11. A coupling tool as defined in claim 10, said second coupling means comprising axial spline means formed on the outer periphery of said body portion.

12. A coupling means as defined in claim 10, said retaining means including a radially outwardly facing groove in the outer periphery of said other end of said body portion, a split ring having a pair of arcuate arms pivotally connected together at adjacent ends and removably receivable in said groove and a retaining means telescopically removable along the outer periphery of said body portion between a first position engaging said split ring and preventing separation of said arms and a second position axially removed from said first position permitting separation of said arms and removal of said split ring from said groove.

13. A coupling tool as defined in claim 10, 11 or 12, said first coupling means including internal thread means formed at said other end of said opening of said body portion.

14. A coupling tool as defined in claim 10 or 11, said first coupling means including at least one pair of dogs mounted on said body portion at said one end thereof on diametrically opposed sides of said opening, each said dog being pivotable between a first position whereat a portion of said dog extends into said opening for engagement with a flattened recess on a drill pipe telescopically disposed in said opening for non-rotatably coupling said pipe to said tool and a second position whereat said dog is disposed exteriorly of said opening permitting axial and rotary movement of said pipe relative to said tool, each said dog being resiliently biased towards said first position.

15. A drill pipe rotary drive mechanism for an earth drilling apparatus, comprising:

a housing;

a tubular drive member mounted in said housing for rotation about a rotary axis, said drive member having an opening concentrically disposed about said axis and adapted to telescopically receive and rotatably drive a drill pipe coupling tool, a radial source abuttingly engageable with a first shoulder on said coupling tool for supporting said coupling tool and limiting axial travel of said tool relative to said member in a first direction, and a second surface spaced from said first surface and abuttingly engageable with a second shoulder associated with said coupling tool for limiting axial travel of said tool relative to said member in a direciton opposite said one direction; and means in said housing for rotatably driving said drive member.

16. A rotary drive mechanism as defined in claim 15, wherein the axial spacing between said radial surface and said second surface of said drive member is less than the spacing between said first shoulder and said second shoulder of said coupling tool by an amount at least equal to the length of the thread of the box or pin of a drill pipe.

17. A rotary drive mechanism as defined in claim 16, wherein said radial surface is annular and disposed at one end of said drive member and said second surface is annular and disposed at the other end of said drive member.

18. A rotary drive mechanism as defined in claim 17, said driving means in said housing including a crown gear concentrically disposed about and connected to said drive members, a drive pinion rotatably mounted in said housing and meshingly engaged with said crown gear and a shaft for driving said pinion.

19. A rotary drive mechanism as defined in claim 18, further including a speed reducer assembly mounted on said housing and drivingly connected to said shaft and motor means for driving said speed reducer.

20. A rotary drive mechanism as defined in claim 19, said motor means being a reversible, variable displacement hydraulic motor.

21. A rotary drive mechanism as defined in claim 15, said opening having axial spline means for mating engagement with spline means on said coupling tool for transferring torque to a coupling tool disposed within said opening.

22. A drill pipe rotary drive mechanism for an earth drilling apparatus, comprising, in combination:

a housing;

a drive member mounted on said housing for rotation therein about a rotary axis and having an axial bore opening at each end to the exterior of said housing and a radial shoulder at each end of said bore;

means in said housing for rotatingly driving said drive member;

a drill pipe coupling tool having a tubular body portion telescopingly removably mounted in said axial bore, said body portion having an axial opening extending therethrough for reception of a portion of the length of a drill pipe, a flange at one end of said body portion engageable with one of said shoulders of said drive member for axially locating said tool in said drive member, first coupling means for non-rotatably coupling said tool to a drill pipe and second coupling means for non-rotatably coupling said tool to said drive member; and coupling tool retaining means on the other end of said coupling tool and being engageable with the other of said shoulders for removably retaining said coupling tool in said bore.

23. A mechanism as defined in claim 22, said second coupling means permitting axial displacement of said tool in said bore and said flange and said retaining means defining predetermined limits of axial travel of said coupling means relative to said drive member.

24. A mechanism as defined in claim 22 or 23, said coupling tool further including a radially outwardly facing groove in the outer periphery of said other end thereof, said retaining means including a split ring having a pair of arcuate arms pivotally connected together at adjacent ends thereof and removably receivable in said groove and a retaining ring telescopingly movable along said body portion between a first position engaging said split ring and preventing separation of said arms and a second position axially removed from said first position permitting separation of said arms and removal of said split ring from said groove.

25. A mechanism as defined in claim 22 or 23, said first coupling means including thread means threadedly engageable with a drill pipe member.

26. A mechanism as defined in claim 22 or 23, said first coupling means including at least one pair of dogs mounted at said one end of said coupling tool on diametrically opposed sides of said axial opening, each said dog being pivotable between a first position whereat a portion of said dog extends into said opening for engagement with a flattened recess of a drill pipe telescopingly disposed in said opening for non-rotatably coupling said pipe to said tool and a second position whereat said dog is disposed exteriorly of said opening permitting axial and rotary movement of said pipe relative to said tool, said dogs being resiliently biased towards said first position.

27. A mechanism as defined in claim 22 or 23, said second coupling means comprising axial spline means on the outer periphery of said body portion of said coupling tool and mating spline means in said bore of said drive member.

28. A drilling apparatus for drilling a borehole in an earth formation, comprising:

an elongated mast having a base at one end for supporting said mast in an upright position at a drill site, a crown at the other end of said mast and a guide track extending longitudinally of said mast from said base to said crown;

a carriage mounted on said track for movement therealong;

a drill pipe rotary drive mechanism having a housing mounted on said carriage for pivotal movement about an axis extending transversely of said mast, a drive member mounted in said housing for rotation about a rotary axis and having an axial bore extending therethrough and opening to the exterior of said housing, and a hydraulic motor for rotatably driving said drive member, said housing being pivotal about said transverse axis between a first position whereat said rotary axis extends parallel to said mast and transversely of said transverse axis and a second position whereat said rotary axis extends tranversely of said mast and said transverse axis;

a drill pipe coupling tool telescopingly removably mounted in said bore of said drive member, first coupling means for non-rotatably said coupling tool to a drill pipe and second coupling means for non-rotatably coupling said tool to said drive member, said coupling tool being axially movable in said bore between predetermined limits;

a carriage actuating mechanism mounted on said mast and connected to said carriage for moving said carriage along said track;

a drill string hoist mechanism mounted on said mast for raising a drill string a predetermined distance; and a wrench mechanism mounted on said base, said wrench mechanism having a wrench movable between a first position whereat said wrench is engageable with a drill pipe for preventing rotation of a drill pipe of a drill string and a second position whereat said wrench is removed from said drill string.

29. A drilling apparatus as defined in claim 28, said carriage actuating mechanism including at least one hydraulic cylinder means extending longitudinally of said mast, one end of said cylinder means being mounted on said base, a piston rod extending from the other end of said cylinder means, a pulley assembly having first and second pulleys mounted on the free end of said piston rod, first cable means having one end secured to said base, the other end secured to said carriage and an intermediate portion trained about said first pulley and a second cable means having one end secured to said base, the other end secured to said carriage and an intermediate portion trained about said second pulley, a first idler pulley mounted adjacent said crown and a second idler pulley mounted adjacent said base, whereby when said piston rod is extended, said carriage is moved towards said crown and when said piston rod is retracted, said carriage is moved towards said base.

30. An apparatus as defined in claim 28, said track including of transversely spaced, U-shaped, opposed channel members extending longitudinally of said mast and said carriage having roller means mounted in said channel members for movement of said carriage along said track.

31. An apparatus as defined in claim 28, said hoist mechanism including a hydraulic cylinder means extending longitudinally of said mast, one end of said cylinder means being connected to said crown, a piston rod extending from the other end of said cylinder means, a pulley rotatably mounted on the free end of said piston rod, a pulley assembly mounted on said crown and a cable means having one end connected to said crown and an intermediate portion trained about said pulley and said pulley assembly and the other end adapted to be connected to the upper end of a drill string.

* * * * *

UNITED STATES PATENT AND TRADEMARK OFFICE

CERTIFICATE OF CORRECTION

PATENT NO. : 4,582,146

DATED : April 15, 1986

INVENTOR(S) : Floyd Walter BECK

It is certified that error appears in the above—identified patent and that said Letters Patent is hereby corrected as shown below:

Claim 15, column 17, line 54, delete "source" and insert in place thereof --surface--.

Claim 18, column 18, line 12, delete "members" and insert in place thereof --member--.

Claim 30, column 20, line 35, after "including" insert --a pair--.

Signed and Sealed this

Eighteenth Day of November, 1986

*Attest:*

DONALD J. QUIGG

*Attesting Officer* *Commissioner of Patents and Trademarks*